US005335491A

United States Patent [19]

Barbier et al.

[11] Patent Number: 5,335,491

[45] Date of Patent: Aug. 9, 1994

[54] COMBUSTION CHAMBER WITH AXIALLY DISPLACED FUEL INJECTORS

[75] Inventors: Gérard Y. G. Barbier, Morangis; Xavier M. H. Bardey, Chartrettes; Michel A. A. Desaulty, Vert Saint Denis, all of France

[73] Assignee: Societe Nationale D'Etude et de Construction de Moteurs D'Aviation S.N.E.C.M.A., Paris, France

[21] Appl. No.: 118,249

[22] Filed: Sep. 9, 1993

[30] Foreign Application Priority Data

Sep. 9, 1992 [FR] France ..... 92 10742

[51] Int. Cl.[5] ..... F23R 3/48

[52] U.S. Cl. ..... 60/39.37; 60/747

[58] Field of Search ..... 60/39.36, 39.37, 737, 60/746, 747

[56] References Cited

U.S. PATENT DOCUMENTS

| | | | |
|---|---|---|---|
| 3,991,560 | 11/1976 | DeCorso et al. . | |
| 4,194,358 | 3/1980 | Stenger | 60/39.36 |
| 4,222,232 | 9/1980 | Robinson | 60/737 |
| 4,408,461 | 10/1983 | Bruhwiler et al. . | |
| 5,081,844 | 1/1992 | Keller et al. | 60/39.39 |

FOREIGN PATENT DOCUMENTS

| | | | |
|---|---|---|---|
| 548057 | 10/1957 | Canada | 60/39.37 |
| 0481111 | 4/1992 | European Pat. Off. . | |

*Primary Examiner*—Richard A. Bertsch
*Assistant Examiner*—Timothy S. Thorpe
*Attorney, Agent, or Firm*—Bacon & Thomas

[57] ABSTRACT

A generally annular combustion chamber for a gas turbine engine is disclosed in which a plurality of generally cylindrical walls extend forwardly from an upstream end wall of the combustion chamber such that each cylindrical wall defines a cavity which is in communication with the interior of the combustion chamber. A first fuel injection head is located in each of the cylindrical walls so as to inject fuel into the cavity which is mixed with air and passes into the combustion chamber. The first fuel injection heads are located at a first axial position with respect to a longitudinal axis passing through the combustion chamber. A plurality of second fuel injection heads are located adjacent to the upstream end wall of the combustion chamber so as to spray fuel directly into the combustion chamber. The second fuel injection heads are located axially downstream of the axial positions of the first fuel injection heads.

8 Claims, 2 Drawing Sheets

COMBUSTION CHAMBER WITH AXIALLY DISPLACED FUEL INJECTORS

BACKGROUND OF THE INVENTION

The present invention relates to a gas turbine engine combustion chamber, more particularly such a combustion chamber having a plurality of axially displaced fuel injection heads.

Gas turbine engines, particularly aircraft turbojet engines, have various modes of operation, in particular a low power mode, a take off mode and a cruising mode. The turbojet engines are required to have low pollution exhaust gases, a requirement which is often in conflict with the requirements to preserve flame stability to avoid combustion chamber flameout during critical flight phases, particularly during landing.

It is known that the production of nitrogen oxides in the exhaust gases are formed at high temperature when the air in the combustion chamber forms a stoichiometric mixture with the fuel and that the production of such nitrogen oxides increases with the amount of time that the stoichiometric mixture dwells in the combustion chamber. These conditions are present in conventional turbojet engines because the combustion chamber volume is quite large in order to assure flame stability at low power operating modes.

In order to reduce the pollutants in the exhaust gases, it has been proposed to provide the combustion chamber with separate fuel injection heads for the low power operating mode and the take off operating mode, which fuel injection heads are radially and axially separated, but supply fuel into a common zone. While this combustion chamber has satisfactorily reduced exhaust pollutants, the radial spacing of the separate fuel injection heads requires the combustion chamber to have an enlarged radial dimension. Furthermore, the large number of fuel injection heads increases both the cost and weight of the turbojet engine.

Another drawback of these known combustion chamber relates to the temperature profile at the combustion chamber outlet when only the lower power fuel injection heads are operating. Since these fuel injection heads are radially spaced from the take off fuel injection heads, the blades of the high pressure turbine, located immediately downstream of the combustion chamber in the exhaust gas flow, are subjected to temperatures near 1,800° K. at their tips and temperature of only approximately 900° K. at their roots. This temperature difference between the blade tips and the blade roots reduces turbine efficiency.

SUMMARY OF THE INVENTION

A generally annular combustion chamber for a gas turbine engine is disclosed in which a plurality of generally cylindrical walls extend forwardly from an upstream end wall of the combustion chamber such that each cylindrical wall defines a cavity which is in communication with the interior of the combustion chamber. A first fuel injection head is located in each of the cylindrical walls so as to inject fuel into the cavity which is mixed with air and passes into the combustion chamber. The first fuel injection heads are located at a first axial position with respect to a longitudinal axis passing through the combustion chamber. A plurality of second fuel injection heads are located adjacent to the upstream end wall of the combustion chamber so as to spray fuel directly into the combustion chamber. The second fuel injection heads are located axially downstream of the axial positions of the first fuel injection heads.

Both the first and second fuel injection heads are arranged in a generally circular array extending about a central axis of the gas turbine engine such that the radii of the arrays of the first and second fuel injection heads are substantially equal. By placing the fuel injection head arrays a common radial distance from the central axis of the gas turbine engine, the overall radial dimension of the combustion chamber is minimized, thereby minimizing the volume occupied by the gas turbine engine.

The fuel injection heads located in the upstream portions of the cylindrical walls constitute the fuel injectors utilized during the low power operating mode, while the fuel injection heads located in the upstream wall of the combustion chamber constitute the fuel injection heads utilized during take-off or cruising operating modes. The cavities defined by the cylindrical walls extending forwardly from the combustion chamber increase the combustion chamber volume to provide a relatively longer dwell time for the combustion gases therein, thereby ensuring flame stability, flame relighting capabilities and increase the efficiency at low power operation, while at the same time providing acceptably low pollution levels.

By placing the two arrays of fuel injection heads the same radial distance from a central axis, the overall radial dimensions of the combustion chamber may be reduced compared to the known combustion chambers. The fuel injection heads of one array alternate circumferentially with the fuel injection heads of the other array. Also, since both fuel injection heads are at the same radial distance from the central axis, the temperature profile of the gases impinging upon the high pressure turbine blades are more homogeneous in a radial direction, thereby increasing the efficiency of the turbine.

Each of the cavities defined by the cylindrical walls communicates with an adjacent cavity via a hollow connecting tube to ensure flame propagation during ignition of the fuel/air mixture therein.

DETAILED DESCRIPTION OF THE PREFERRED EMBODIMENTS

Figure 1:
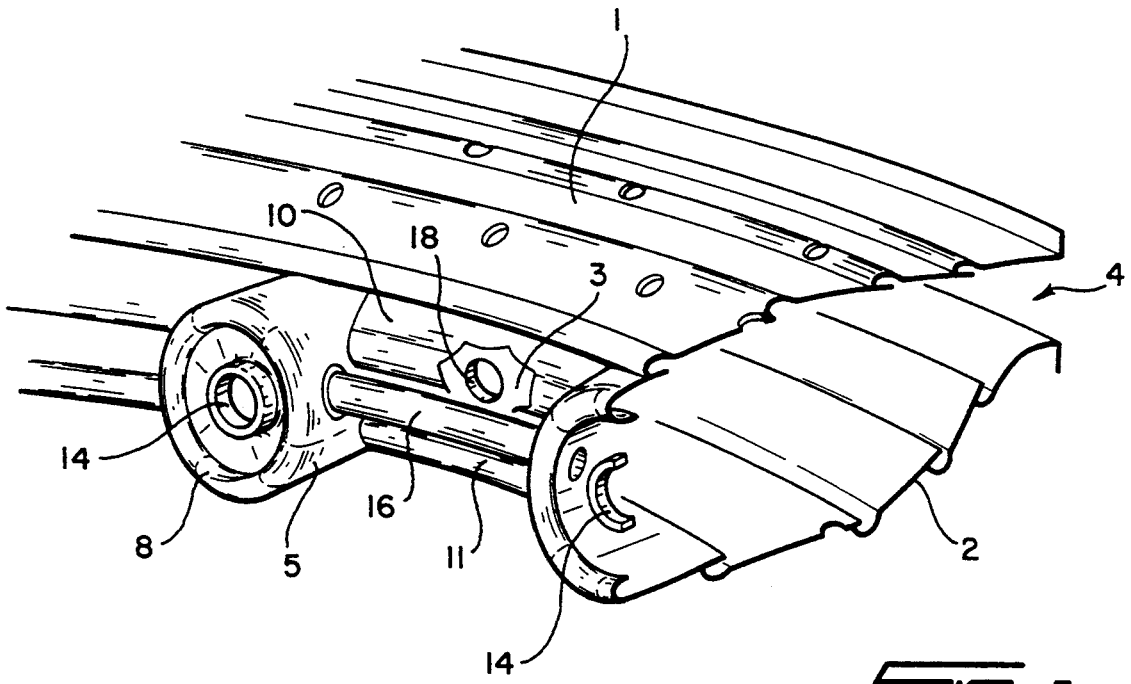
FIG. 1 is a partial, perspective view, partially broken away, illustrating the combustion chamber according to the present invention.

FIG. 1 illustrates a generally annular, gas turbine combustion chamber 7 bounded by an outer annular wall 1, an inner annular wall 2 and a transverse, forward, upstream end wall 3 which connects outer wall 1 and inner wall at their upstream ends. The downstream ends of walls 1 and 2 define an exhaust passage 4 to enable the combustion gases to exit the combustion chamber in a downstream direction. It is to be understood that the gases passing through the combustion chamber will pass from an upstream direction (forward end wall 3) downstream towards the exit passage 4 (from left to right as viewed in FIGS. 3–5).

A plurality of generally cylindrical walls 5 extend forwardly from the upstream end wall 3 in a direction generally opposite to the overall gas flow direction through the combustion chamber. The cylindrical wails 5 define therein cavities 6 which communicate with the interior of the combustion chamber in a direction generally parallel to the overall gas flow direction through the combustion chamber.

Each of the cylindrical walls 5 has a visor 8 which extends forwardly from a forward end of the cylindrical walls, the visors 8 defining first stabilizing chambers 9 which receive primary oxidizer (such as air) from a diffuser 20.

Figure 2:
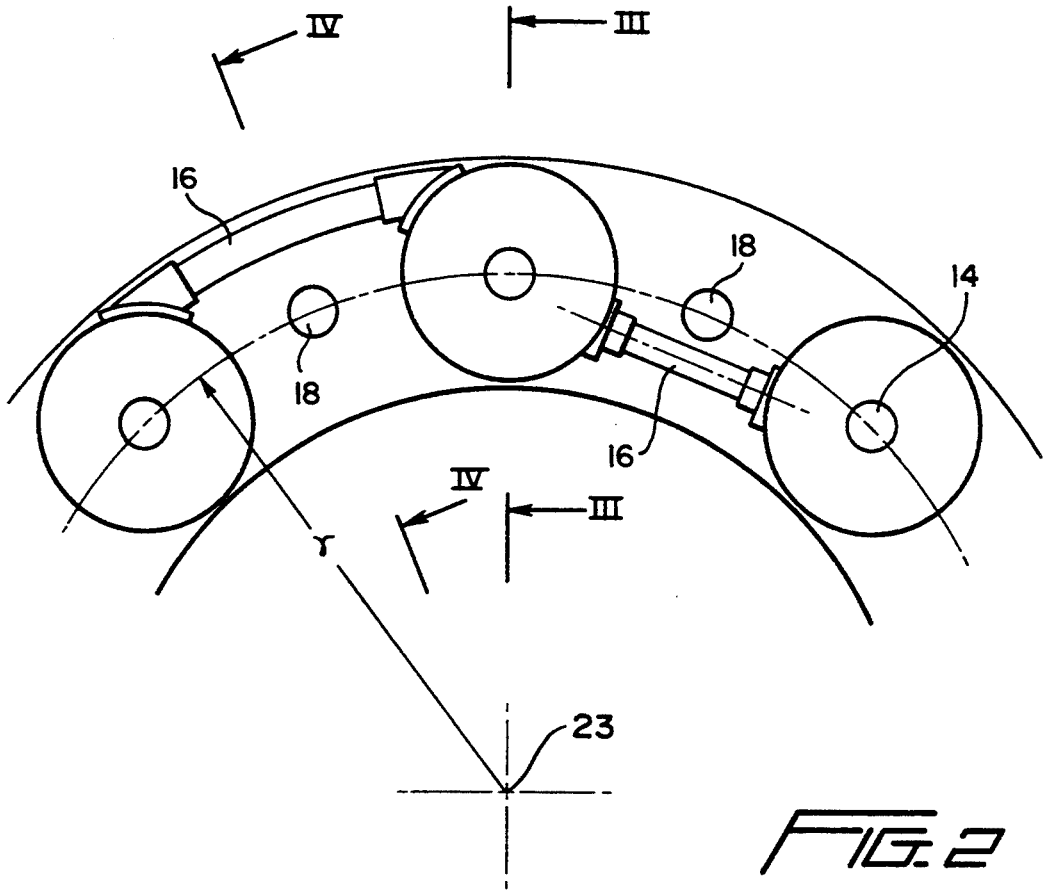
FIG. 2 is a partial, front view of the combustion chamber illustrated in FIG. 1.

As illustrated in FIGS. 1–2, the centers of cylindrical walls 5 are generally equidistantly circumferentially distributed about the central axis 23 of the gas turbine engine (not otherwise shown). Cylindrical walls 5 are centered on a circle having a radius r from the central axis 23 such that they are located in a generally circular array.

Figure 4:
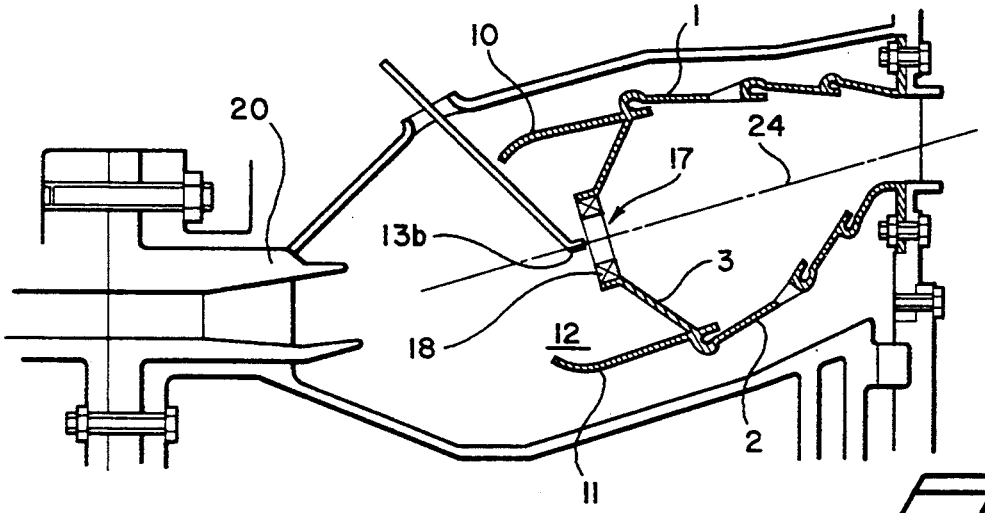
FIG. 4 is a cross-sectional view taken along line IV—IV in FIG. 2 illustrating a first embodiment of the invention.

Extension plates 10 and 11 extend forwardly from the juncture of the upstream end wall 3 with the outer wall 1 and the inner wall 2, and extend circumferentially around axis 23 between adjacent cylindrical walls 5. The extension plates 10 and 11 define, with the upstream end wall 3, second stabilizing chambers 12 which also receive primary oxidizer (such as air) from the diffuser 20, as illustrated in FIG. 4.

Figure 3:
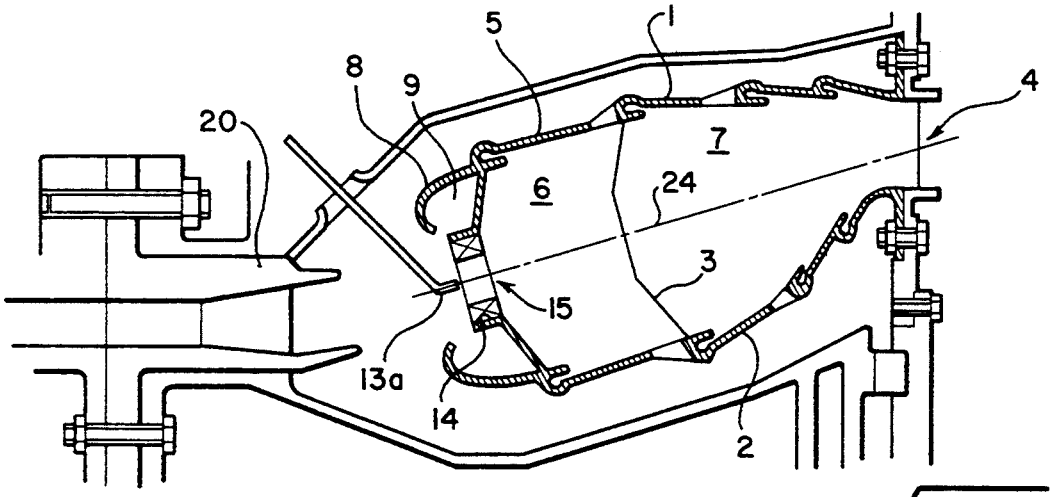
FIG. 3 is a cross-sectional view taken along line III—III in FIG. 2.

The combustion chamber 7 is equipped with a plurality of fuel injectors 13 which are split into two sets of injectors. The fuel injectors 13*a* of the first set, the "drive" or low-power operating mode injectors, are mounted in apertures 14 defined by the upstream, forward ends of the cylindrical walls 5 and supply fuel to the low power fuel injection heads 15. Accordingly, each cylindrical wall 5 is fitted with a low-power fuel injection head 15 at the upstream end of cavity 6, as best illustrated in FIG. 3. Connection tubes 16 extend generally transverse to the axis 23 and interconnect adjacent cavities 6 to provide for flame propagation between the cavities during ignition of the gases within the combustion chamber.

The fuel injectors 13*b* of the second set, the full-power or take-off injectors are circumferentially located between the first fuel injectors 13*a* (the "drive" injectors) when viewed from the forward end, as illustrated in FIG. 2. The second set of injectors 13*b* supply fuel to the take-off or full power fuel injection heads 17 which are located in openings 18 formed in the upstream end wall 3. The take off or full power fuel injection heads 17 are located axially downstream of the "drive" or low power fuel injection heads 15 along a longitudinal axis 24 passing through the combustion chamber, as illustrated in FIGS. 3 and 4.

The take off or full power fuel injection heads 17 are also arranged in a generally circular array extending about central axis 23. The radius of this circular array is also radius r, the same as the radius for the circular array of "drive" or low power fuel injection heads 15.

As can be seen, the extra volume provided by the cavities 6 increase the dwell time of the fuel/air mixture entering from "drive" or low-power fuel injection heads 15, thereby enhancing the flame stability and increasing the relighting capabilities of the combustion gases should flameout occur. The efficiency of the combustion chamber during low-power operating modes is also increased, while at the same time the pollution levels of the exhaust gases are at an acceptable level.

Figure 5:
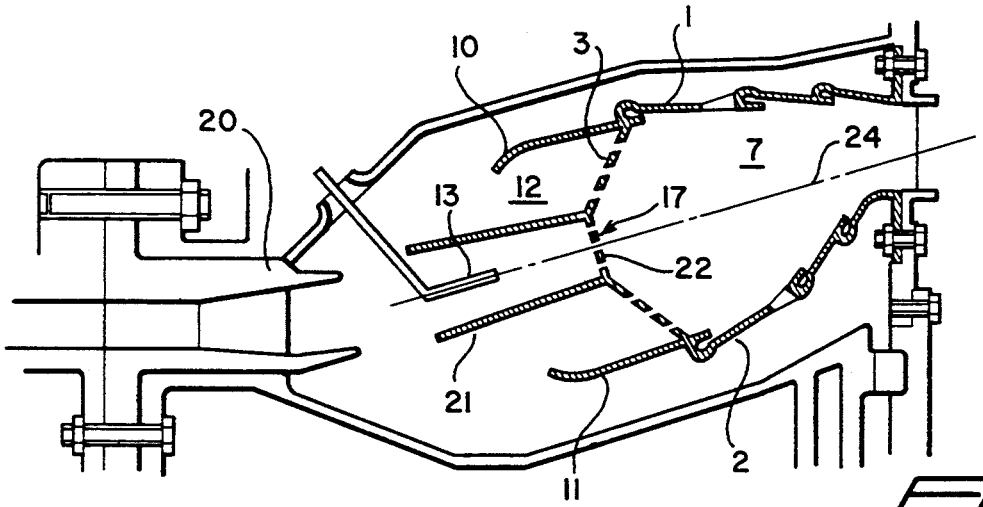
FIG. 5 is a cross-sectional view taken along line IV—IV of FIG. 2 illustrating a second embodiment of the combustion chamber according to the present invention.

A second embodiment of the invention is illustrated in FIG. 5. In this embodiment, the take off or full power fuel injection heads 17 each comprise a tubular premixing module 21 located between adjacent circular walls 5 extending forwardly from the end wall 3 in the second stabilizing chambers 12. A known, flame stabilizing grid 22 may be located at the juncture of the premixing module 21 and the end wall 3. In this embodiment, the full power or take off fuel injector may be a pencil-type injector.

In both embodiments, the combustion chamber 7 of the present invention comprises two circular arrays of alternating fuel injection heads which are axially offset relative to each other and to the plane of the exhaust opening 4 of the combustion chamber. The location of the "drive" or low power fuel injection heads 15 assure performance of the turbojet engine in low power modes of operation. At the same time, the full power or take off fuel injection heads 17 ensure good engine performance under full load operating conditions. Each set of fuel injection heads consists of an adequate number of fuel injection heads to provide the proper fuel/air mixture matching the operational modes and the desired performance. Although the invention has been described assuming equal number of low power fuel injection heads 15 and take off fuel injection heads 17, quite obviously, the relative numbers of each of the fuel injection heads may be altered, depending upon the specific operating parameters of an individual gas turbine engine. In order to achieve better control over the fuel/air mixture, each fuel injection head may be equipped with known air flow control valves.

The apportioning of fuel between the two arrays of fuel injection heads may be a function of the flight operating modes of the aircraft and/or air distribution. The "drive" or low power fuel injection heads may be functioning during all flight times, with the take off or full power fuel injection heads operative when taking off or when the aircraft undergoes highspeed cruising.

The foregoing description is provided for illustrative purposes only and should not be construed as in any way limiting this invention, the scope of which is defined solely by the appended claims.

We claim:

1. A generally annular combustion chamber for a gas turbine engine, the combustion chamber having an upstream wall interconnecting generally annular inner and outer walls with a longitudinal axis extending between the forward, upstream wall and a rear, downstream end, and comprising:

a) a plurality of generally cylindrical walls extending forwardly from the upstream wall of the combustion chamber, each generally cylindrical wall having an upstream end and defining therein a combustion cavity in communication with the annular combustion chamber;

b) a first fuel injection head located adjacent to the upstream end of each generally cylindrical wall, the first fuel injection heads being located at a first axial position on the longitudinal axis;

c) a plurality of second fuel injection heads located adjacent to the upstream wall of the annular combustion chamber at a second axial position downstream of the first axial position; and, d) a hollow tube connected between adjacent generally cylindrical walls upstream of the upstream wall of the annular combustion chamber such that the combustion cavities defined by the respective generally cylindrical walls are in communication with each other through the hollow tube.

2. The combustion chamber of claim 1 further comprises a generally annular visor extending forwardly from the upstream end of each generally cylindrical wall.

3. The combustion chamber of claim 1 wherein the second axial position is substantially coincident with the upstream wall of the annular combustion chamber.

4. The combustion chamber of claim 1 further comprising:

a) a generally tubular premixing module located at each of the plurality of second fuel injection heads defining a fuel/air premixing chamber; and b) a flame stabilizing grid located at a juncture of the premixing module and the combustion chamber.

5. The combustion chamber of claim 1 wherein the gas turbine engine has a central axis and wherein the first fuel injector heads are arranged in a substantially circular first array around the central axis.

6. The combustion chamber of claim 5 wherein the plurality of second fuel injector heads are arranged in a substantially circular second array around the central axis.

7. The combustion chamber of claim 6 wherein the radius of the substantially circular first array is substantially equal to the radius of the substantially circular second array.

8. The combustion chamber of claim 7 wherein a second fuel injection head is circumferentially located between two adjacent first fuel injection heads.

* * * * *